US009870689B1

(12) United States Patent
Deluca et al.

(10) Patent No.: US 9,870,689 B1
(45) Date of Patent: Jan. 16, 2018

(54) CODEPENDENT ALARM DEVICE

(71) Applicant: INTERNATIONAL BUSINESS MACHINES CORPORATION, Armonk, NY (US)

(72) Inventors: Lisa Seacat Deluca, Baltimore, MD (US); Henry C. Will, IV, Dover, NJ (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/245,620

(22) Filed: Aug. 24, 2016

(51) Int. Cl.
*G08B 23/00* (2006.01)
*G08B 21/06* (2006.01)

(52) U.S. Cl.
CPC ..... *G08B 21/06* (2013.01)

(58) Field of Classification Search
CPC ..... G08B 21/06
USPC ..... 340/575, 573.1
See application file for complete search history.

(56) References Cited

U.S. PATENT DOCUMENTS 7,012,534 B2 3/2006 Chaco
8,096,960 B2 1/2012 Loree, IV et al.
8,493,220 B2 7/2013 Virtanen et al.
9,207,647 B2 12/2015 Welzien et al.
9,208,676 B2 12/2015 Fadell et al.
9,692,874 B2 * 6/2017 Raymann ..... H04L 67/22
2008/0167535 A1 * 7/2008 Stivoric ..... G01R 29/0814 600/301
2011/0015467 A1 * 1/2011 Dothie ..... A61B 5/11 600/26
2011/0230790 A1 * 9/2011 Kozlov ..... A61B 5/4812 600/595
2011/0267196 A1 * 11/2011 Hu ..... A61B 5/0002 340/575
2012/0300598 A1 * 11/2012 Murray ..... G04G 13/02 368/251
2012/0327748 A1 12/2012 Lee
2014/0171146 A1 6/2014 Ma et al.
2016/0151603 A1 * 6/2016 Shouldice ..... H04R 3/00 600/28
2016/0234034 A1 * 8/2016 Mahar ..... H04L 12/282
2017/0188938 A1 * 7/2017 Toh ..... A61B 5/4809

OTHER PUBLICATIONS

Peter Mell et al, The NIST Definition of Cloud Computing, National Institute of Standards and Technology, Publication 800-145, 2011.

(Continued)

*Primary Examiner* — Eric M Blount
(74) *Attorney, Agent, or Firm* — Patrick J. Daugherty; Driggs, Hogg, Daugherty & Del Zoppo Co., LPA

(57) ABSTRACT

Aspects optimize an alarm time as a function of biometric sleep data. Biometric sleep data is generated from monitoring a sleeping person. A readiness period of time is determined as required for a selected caregiver to complete a task prior to tending to the sleeping person. A probability that the sleeping person will wake within the readiness time period from a current time is determined from the biometric sleep data of the sleeping person. Accordingly, an alarm is initialized (given, broadcast, etc.) to the selected caregiver in response to determining that the wake probability meets a threshold certainty value.

20 Claims, 4 Drawing Sheets

(56) References Cited

OTHER PUBLICATIONS

Disclosed Anonymously, Method and System for Dynamically Adjusting an Alarm Clock Based on Work-Related Factors and User Preferences, IP.com, 2012.
Nerdwallet, 5 Things You Didn't Know Your Fitbit Flex Could Do, https://www.nerdwallet.com/blog/shoping, 2016.
Sparkpeople, You Could Wake Up Naturally to a More Energized Day, http:/www.sparkpeople.com/resource/articles, 2016.
Fitbit, What should I know about sleep tracking?, https://help.fitbit.com/articles/en_US/Help, 2016.
Owlecare, A little help for the hardest job in the world, Baby Vitals Monitor—Smartphone Baby Monitor, htts://www.owlecare.com, 2016.

* cited by examiner

CODEPENDENT ALARM DEVICE

BACKGROUND

Alarm devices offer a wide variety of features and methodology for notifying a person of an event. Alarms may be triggered by the occurrence of an unscheduled event, for example alarm sounds broadcast over public address system speakers in a fire station to wake firefighters to respond to an immediate request for assistance for health or safety emergencies occurring during night time hours. Applications also include "alarm clocks" that wake a person from sleep through sound, touch or other stimulus inputs in response to the occurrence of a scheduled or designated time of day. For example, a morning wake-up time or range of times may be chosen to generate an alarm that occurs early enough to enable an alarm device user to wake and get dressed and otherwise get ready to travel to an employer by the beginning of a work day.

People require regular periods of sleep of sufficient time and quality to maintain proper body function and health, most commonly during the nighttime. Sleep periods comprehend a variety of different and distinct patterns or cycles, including rapid-eye-movement (REM) sleep and non-rapid-eye-movement (NREM) sleep cycles. REM sleep is often considered "active sleep" and is identifiable by characteristic lower-amplitude (small), higher-frequency (fast) waves and alpha rhythms as determined by electro-encephalogram (EEG) data relative to NREM sleep, as well as the eye movements for which it is named. NREM sleep may be further described by three distinct and different stages: N1, N2, and N3. In the progression from stage N1 to N3, brain waves become slower and more synchronized, and the eyes remain still. In stage N3, the deepest stage of NREM, EEGs reveal high-amplitude (large), low-frequency (slow) waves and spindles. This stage is referred to as "deep" or "slow-wave" sleep. (See "Healthy Sleep: Natural Patterns of Sleep," Division of Sleep Medicine at Harvard Medical School, August 2016, http://healthysleep.med.harvard.edu/healthy/science/what/sleep-patterns-rem-nrem.)

Waking from sleep may be difficult. Users of alarms to trigger wakefulness may feel that they have not had a sufficiently long, or sufficiently restful (uninterrupted) period of sleep to meet their personal, restorative needs. Accordingly, users commonly delay waking times by the use of "snooze alarm" routines that silence alarms for a designated delay period of minutes, at the lapse of which the alarm again sounds, wherein the user may go back to sleep and enjoy an additional period of sleep during the delay period, in order to more gradually awaken over the snooze time period, or to perceive that they have enjoyed additional sleep time and thereby feel more refreshed and ready to wake up.

Being woken by alarms or other stimuli at unpredictable times that interrupt user sleep patterns and schedules may have debilitating effects on users, leaving users feeling tired and unrefreshed. Experiencing a jarring or frantic start to the day may leave a person feeling relatively more poorly later in the day, with lower perceived levels of energy, creativity, spontaneity, concentration, motivation, tolerance for stress, etc., relative to awaking from sleep naturally, such as at the end of an appropriate sleep cycle in response to internal biological clock and sleep-wake homeostat system functioning. (See "You Could Wake Up Naturally to a More Energized Day: Small Changes Can Mean BIG Energy," M. Kramer, Sparkpeople, August 2016, http://www.sparkpeople.com/resource/wellness_articles.asp?id=329.)

BRIEF SUMMARY

In one aspect of the present invention, a computerized method for optimizing an alarm time as a function of biometric sleep data executes steps on a computer processor. Thus, a computer processor generates biometric sleep data from monitoring a sleeping person. A readiness period of time is determined as required for a selected caregiver to complete a task prior to tending to the sleeping person. A probability that the sleeping person will wake within the readiness time period from a current time is determined from the biometric sleep data of the sleeping person. Accordingly, an alarm is initialized (given, broadcast, etc.) to the selected caregiver in response to determining that the wake probability meets a threshold certainty value.

In another aspect, a system has a hardware processor in circuit communication with a computer readable memory and a computer-readable storage medium having program instructions stored thereon. The processor executes the program instructions stored on the computer-readable storage medium via the computer readable memory and thereby generates biometric sleep data from monitoring a sleeping person. A readiness period of time is determined as required for a selected caregiver to complete a task prior to tending to the sleeping person. A probability that the sleeping person will wake within the readiness time period from a current time is determined from the biometric sleep data of the sleeping person. Accordingly, an alarm is initialized (given, broadcast, etc.) to the selected caregiver in response to determining that the wake probability meets a threshold certainty value.

In another aspect, a computer program product for optimizing an alarm time as a function of biometric sleep data has a computer-readable storage medium with computer readable program code embodied therewith. The computer readable hardware medium is not a transitory signal per se. The computer readable program code includes instructions for execution which cause the processor to generate biometric sleep data from monitoring a sleeping person. A readiness period of time is determined as required for a selected caregiver to complete a task prior to tending to the sleeping person. A probability that the sleeping person will wake within the readiness time period from a current time is determined from the biometric sleep data of the sleeping person. Accordingly, an alarm is initialized (given, broadcast, etc.) to the selected caregiver in response to determining that the wake probability meets a threshold certainty value.

BRIEF DESCRIPTION OF THE DRAWINGS

These and other features of embodiments of the present invention will be more readily understood from the following detailed description of the various aspects of the invention taken in conjunction with the accompanying drawings in which.

DETAILED DESCRIPTION

Figure 1:
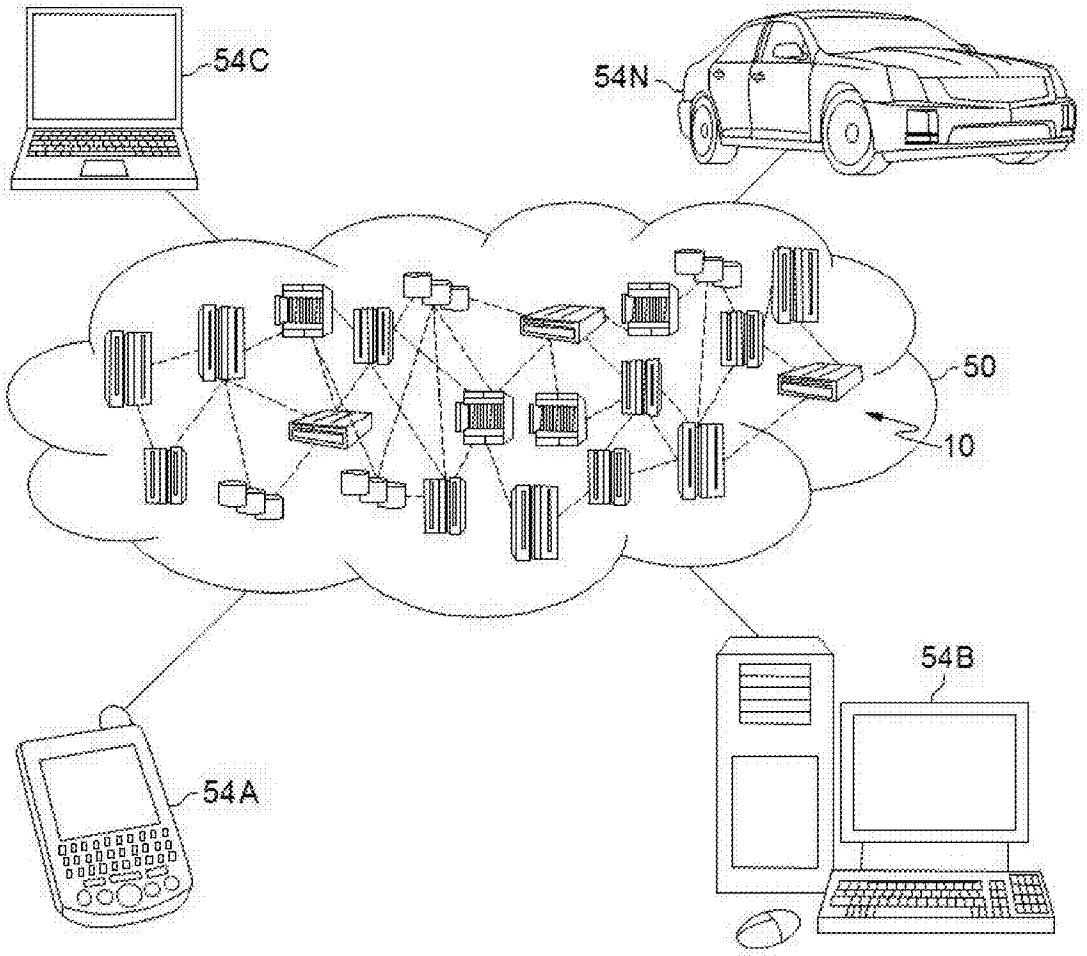
FIG. 1 depicts a cloud computing environment according to an embodiment of the present invention.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

It is understood in advance that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g. networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure comprising a network of interconnected nodes.

Referring now to FIG. 1, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
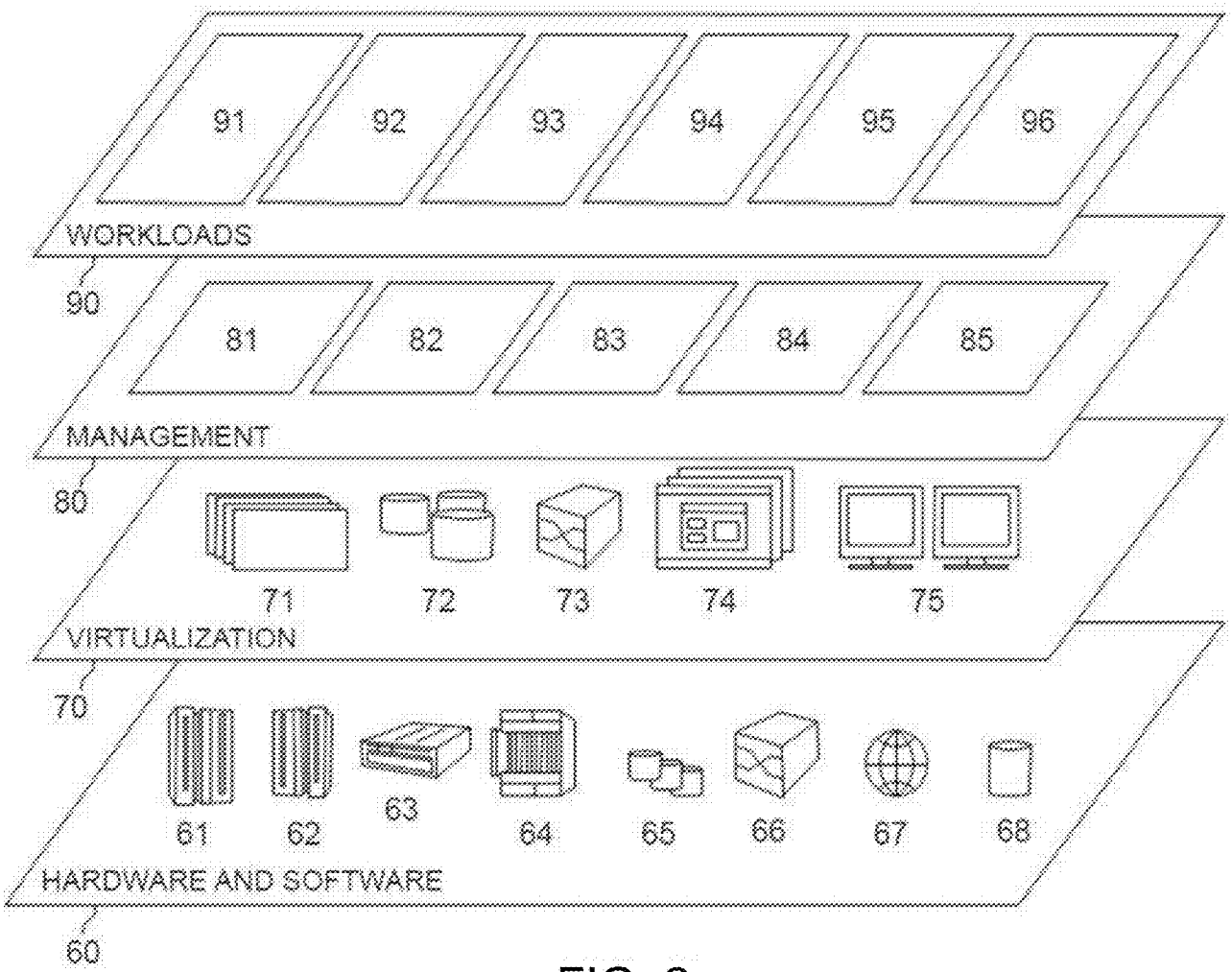
FIG. 2 depicts a cloud computing node according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Figure 4:
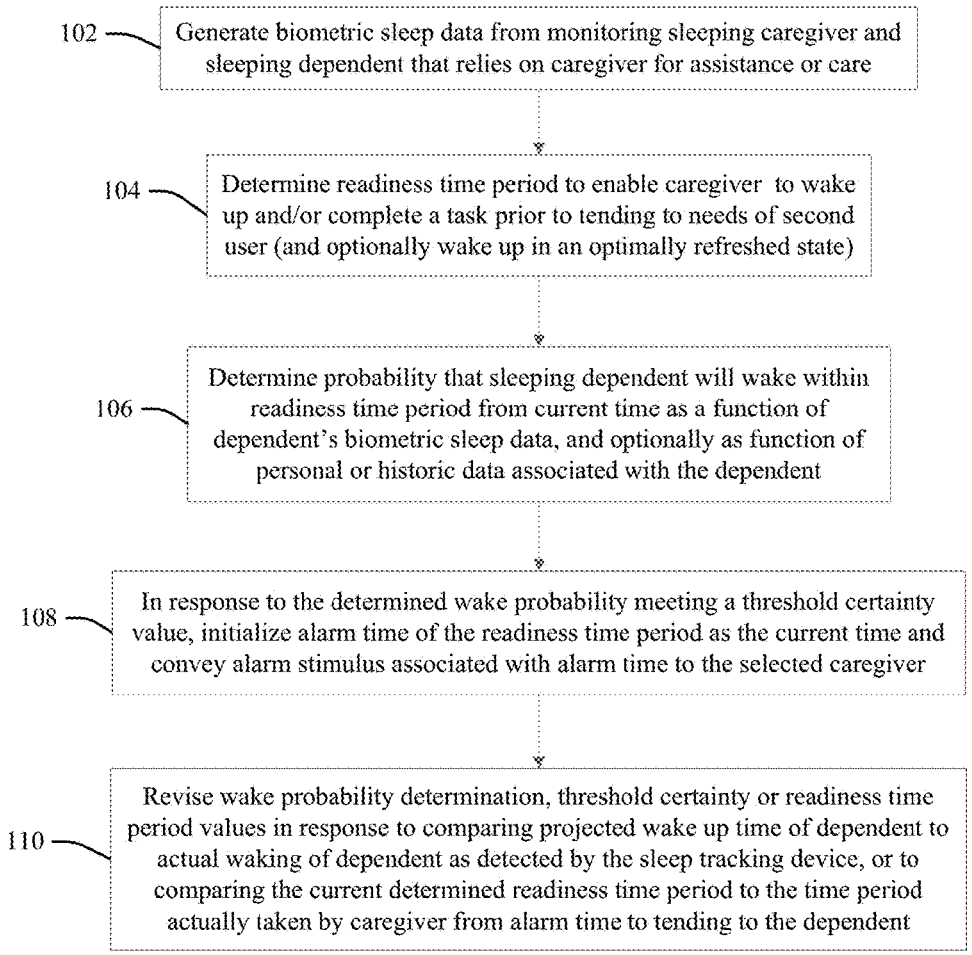
FIG. 4 is a flow chart illustration of a process or system for optimizing an alarm time as a function of biometric sleep data according to an embodiment of the present invention.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and processing 96 for optimizing an alarm time as a function of biometric sleep data according to embodiments of the present invention, for example to execute the process steps or system components or tasks as depicted in FIG. 4 below.

Figure 3:
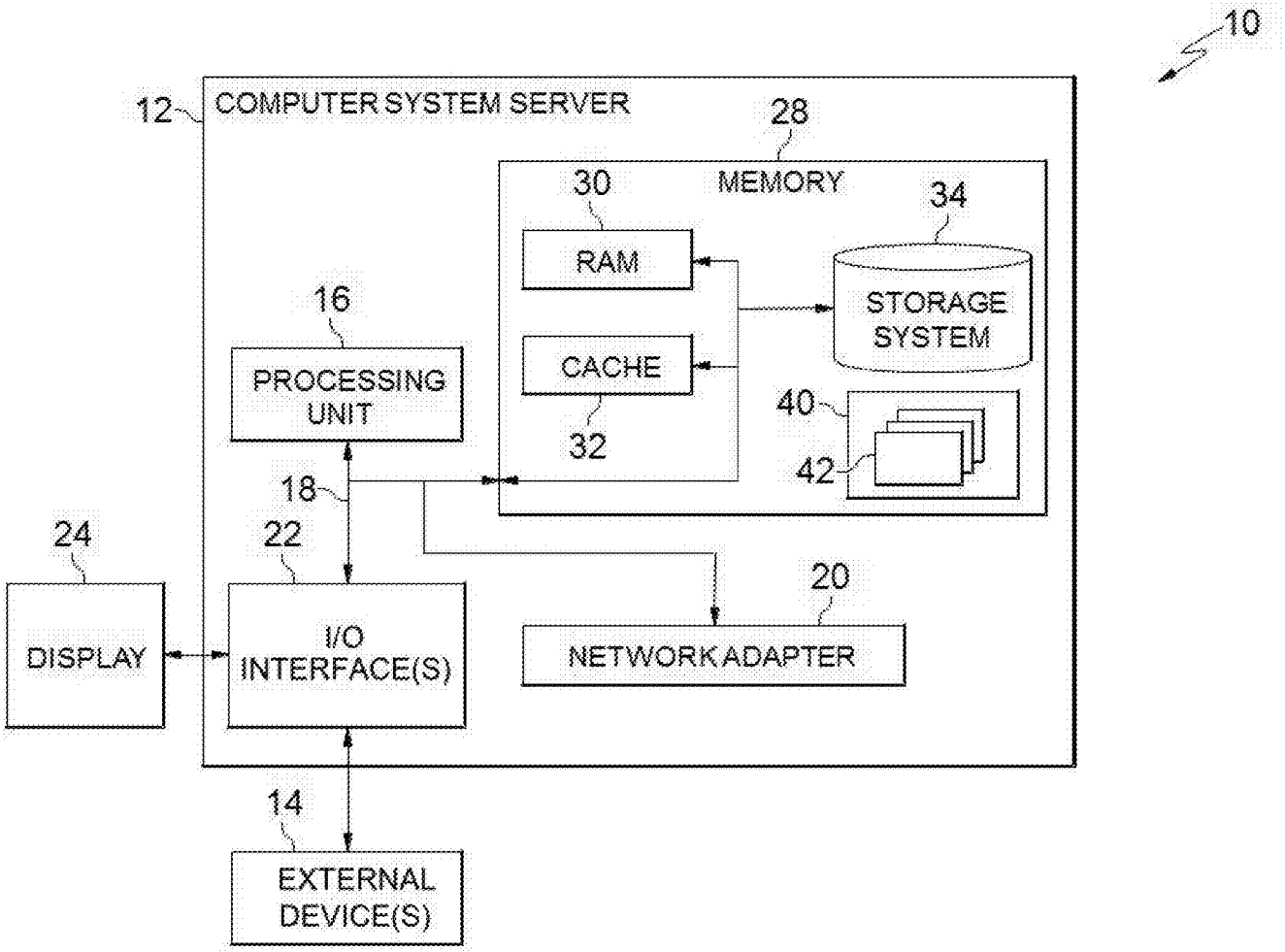
FIG. 3 depicts a computerized aspect according to an embodiment of the present invention.

FIG. 3 is a schematic of an example of a programmable device implementation 10 according to an aspect of the present invention, which may function as a cloud computing node within the cloud computing environment of FIG. 2. Programmable device implementation 10 is only one example of a suitable implementation and is not intended to suggest any limitation as to the scope of use or functionality of embodiments of the invention described herein. Regardless, programmable device implementation 10 is capable of being implemented and/or performing any of the functionality set forth hereinabove.

A computer system/server 12 is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, hand-held or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system-executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

The computer system/server 12 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnects (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32.

Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, external disk drive arrays, RAID systems, tape drives, and data archival storage systems, etc.

FIG. 4 illustrates a process or system according to the present invention for optimizing an alarm time as a function of a dependent relationship of sleep pattern data from different sleepers. At 102 biometric sleep data is generated from observing and monitoring a plurality of respective sleepers including a first "caregiver" sleeper and a different, second sleeper that is dependent upon the first, caregiver sleeper for personal care or attention (for example, an infant child relying upon a parent caregiver, or an elderly or ill patient under the care and responsibility of a first caregiver). In order to help distinguish between respective sleepers in the following illustrative but not limiting or exhaustive example, the first sleeper may be referred to hereinafter sometimes as the "caregiver" or "caregiver sleeper", and the second sleeper as the "dependent" or "dependent sleeper." However, it will be understood that this identification terminology and nomenclature is not limiting with respect to the relationships between the different first and second sleepers in embodiments of the present inventions.

Generating the biometric sleep data includes via use of personal sleep tracking devices or services that track and generate for each of the respective sleepers one or more of observations or determinations of movements, sleep movement patterns or cycles over time, sounds, oxygen levels, breathing rates, restlessness, efficiency and body temperatures. In one illustrative but not limiting or exhaustive example a quality of restlessness is determined from detecting movements between different specific positions, wherein a restless state of sleep is indicated by recognizing movement of the sleeper from a more restful position to another that is associated with greater amounts of effort or frequencies of movement, such as recognizing motion associated with turning over in bed. A quality of sleep efficiency may also be defined as a function of respective periods of times of restful sleep, restless sleep, and wakefulness during the night, for example defining a sleep efficiency value as equal to "100*time asleep/(time asleep+time restless+time awoken during sleep)." (See "How do I track my sleep?" https://help.fitbit.com/articles/en_US/Help_article/1314#howissleepeff).

At 104 a "readiness" period of time is dynamically determined for a caregiver to enable the caregiver to wake up and complete one or more specified or desired tasks prior to tending to the needs of one of the second (dependent) sleepers, as a function of minimum specified task time periods or historic readiness time periods observed for the caregiver. The readiness time period is generally defined to be of sufficient length of time to enable the caregiver to complete the performance of required or desired tasks after waking or alert, before the dependent wakes up and personal attention is immediately required from the caregiver. For example, in the case where the wake time is a morning time at which the caregiver is woken from sleeping through the night, the readiness time period enables the caregiver to get up and out of bed, get dressed, perform ablutions, make coffee, have breakfast, read morning news, etc., before tending to the needs of the dependent.

Generally the end of the readiness time period is a time at which the dependent sleeping person awakes, as determined by a personal sleep tracking device or service, though other onset times of service to the dependent may be defined. For example, an infant dependent may be allocated some wake up time period alone in a crib prior to attendance by the caregiver.

Readiness time periods may comprehend additional "snooze time periods," wherein a first alarm occurs at an initial alarm time, and a snooze time period then elapses to trigger a second alarm, enabling the sleeping caregiver to enjoy another period of sleep during the snooze period in order to more gradually wake up prior to commencing readiness tasks.

In some aspects the length of the readiness time period is determined for a given caregiver as a function of the caregiver's biometric sleep data, in order to optimize sleeping time or alarm methodology to enable the caregiver to awake in a refreshed state. Thus, the readiness time period may be optimized to the current sleep status of the caregiver to provide enough time elapsing from an initial, "waken" time at which the caregiver wakes or is otherwise alerted to commence getting ready, to a later, "ready" time at which the caregiver is projected to be ready to tend to the needs of the dependent upon wakening of the dependent. Thus, if the caregiver's biometric sleep data indicates that the caregiver has slept poorly, the time period may be extended to give the caregiver additional time to wake up, or to hit a "snooze" button on an alarm and grab some additional sleep time; or the period may be shortened, to give the caregiver additional time to sleep before be wakened by an alarm triggered by the onset of the readiness time period.

In some aspects the length of the readiness time period is dynamically determined from sleep data monitored for the caregiver to comprehend a minimum threshold minimum task period of time where the sleep data indicates that the caregiver is not completely rested, and would benefit from additional sleep in order to enable the caregiver to complete at least a minimal number of prioritized tasks, for example three (3) minutes get dressed and refreshed. In response to determining that the monitored sleep data indicates that the caregiver is well rested, or is presently within an optimal sleep cycle for waking, then the length of the readiness time period may be dynamically extended (the caregiver is awakened earlier) to also comprehend an optional, additional time period of time of five (5) minutes that enables the caregiver to also make coffee, consume some breakfast food, retrieve a newspaper, etc., prior to tending to the needs of the dependent.

Alarm stimuli preferences may also be defined for the caregiver at 102, for example choosing initial and snooze time alarm stimuli between options including alarm buzzers or tones, audio presentations of music files or radio stations tuned on an alarm clock device, cell phone vibrators or ring tone alerts, wearable device vibrations or other physical stimulus, etc. Graduation volume profiles may also be specified, for example gradually increasing over time to a desired loudness level when the sleep pattern data indicates that the caregiver is not well rested, or is in a deep sleep cycle; and selecting a brief, louder alarm if the caregiver is well rested or in a shallow or lighter level of sleep.

At 106 a probability is dynamically determined from the generated biometric dependent sleep data that the sleeping dependent will wake within or after said readiness time period from a current time; and in some examples, also as a function of personal or historic data associated with the dependent.

At 108, the initial wake time of the caregiver's readiness time period is triggered (initialized, etc.) as the current time, and an alarm stimuli associated with the initial wake time is conveyed to the caregiver, in response to determining that the current wake probability meets a threshold certainty that the sleeping dependent will wake within, or by the end of, the readiness time period determined for the caregiver, relative to the current time. This alarm wakes the caregiver or otherwise notifies the caregiver that the dependent is waking, or it is probable that the dependent will be awake by the end of a desired, optimized or appropriate readiness time period into the future. This alarm gives the caregiver an opportunity to get mentally ready to tend to the dependent prior to the dependent actually awakening and/or needing assistance. Thus, an appropriate and/or preferred alert method is invoked, for example playing desired music at a slowly rising volume level, to slowly and gently wake the caregiver, or quickly rousing the caregiver through a standard alarm, etc.

At 110 one or more of the wake probability determination, the threshold certainty or the readiness time period values are adjusted or revised in response to comparing the projected wake up time of the dependent to an actual waking of the dependent as detected by the sleep tracking device, or to comparing the current determined readiness time period to the time period actually taken by the caregiver from alarm time to tending to the needs of the dependent. For example, if the dependent does not wake at the readiness time period of time after the time of alarm of the caregiver, but instead at a later time, then determined motion pattern matching certainties or probabilities may be revised for future iterations (for the next and future nights of sleeping by the caregiver and dependent). Similarly, if motion or sound data monitored by the device with respect to the dependent indicates that the caregiver has not entered the room where the dependent is sleeping, or picked up the dependent if the dependent is an infant, etc., within the readiness time period from the alarm time, the determined readiness times may be extended by an additional time (or fraction thereof). This adjustment may also be in response to present sleep cycle or pattern or restfulness attributes of the caregiver. Caregivers may also provide feedback adjustments, for example observing or indicating that they were woken too soon or too late for a specific dependent sleeper, so that in the future the alarm time is adjusted to a later or sooner time for the same dependent sleeper. Aspect thereby learn optimal relationships between the wake probability values, readiness time periods and dependent motion and sound patterns, tweaking the system and improving performance over time with each iteration of additional data to improve performance to meet the needs of each caregiver and dependent in accurately projecting appropriate alarm times in advance of anticipated needs for assistance by the dependents.

Wake probabilities and sleep pattern and quality determination of the respective sleepers may be determined through a variety of methodology. Personal sleep tracking devices, accelerometers, cameras, microphones, pulse and oxygen ("pulse-ox") monitors, sleep apnea devices, electroencephalogram (EEG), electrocardiogram (EKG or ECG) and other medical or environmental monitoring devices may monitor movements and biometric data over time of a sleeper to determine patterns of movements and other biometric data indicators correlated to current sleep pattern status (for example, in deep sleep, transitioning between different cycles during a continued period of sleep, waking up, indicative of restful or fitful sleep in the context of other cycles and patterns observed over the night, etc.).

For example, movements determined from camera or accelerometer data may be compared to historical movement patterns over time that are personalized to sleepers, or to generic patterns applicable to sleepers as a function of age, body weight, gender, or other attributes shared with others in historical data. Determining the probability that the dependent will wake at a future point in time, such as within a period of time into the future that is equal to or within a length of time defined by the readiness time period, may be accomplished by strength of match of current motion pattern data to historic motion patterns wherein the monitored sleeper historically wakes within a similar amount of time. Sleepers may present movement patterns during sleeping or awaking that are personally unique, tossing and turning differently than others, and thus aspects may customize pattern matching to unique patterns determined from historical motions of monitored sleepers that are correlated with awakening or remaining asleep the readiness time period in the future.

Monitoring sound emanated by the sleepers via a microphone may identify sounds and patterns of sounds over time that indicative of current sleep pattern status, and of waking events that occurring within time frames correlated to the readiness time periods, to thereby determine the wake probability of the dependent over said upcoming time frames. For example, observations that breathing rhythm has increased, or slowed, or that the dependent has stopped snoring, etc., may be matched to similar sounds or patterns in historic data that are linked to awakening or to remaining asleep. Monitored motion and sound data may be considered independently, or in combination with motion patterns or other biometric data, to predict wake probabilities over future time frames.

One skilled in the art may also use sleeper biometric data including pulse-ox readings, sleep apnea device outputs, EEG and EKG data to determine current sleep pattern status and/or dynamic wake probabilities.

In some aspects different pairings of pluralities of caregivers and dependents, as well as different readiness time period and wake probability determinations for the respective pairings, may identified and used to select a best caregiver for given wake probability, based on unique attributes of caregivers or dependents within the pairings. In one example implementation caregivers "Devon" and "Leslie" are parents of four young dependent children, two sets of twins, aged three years old and six months respectively. Without utilizing aspects of the present invention for their morning routines results, Devon and Leslie would be woken suddenly by a baby crying or a toddler screaming for immediate attention. Such sudden, jarring and immediate demands for attention upon waking are emotionally and physically draining and exhausting for both Devon and Leslie.

In contrast, utilizing an aspect of the process and system of FIG. 4 Devon and Leslie each wear personal sleep monitor devices. Upon determinations of wake probability determinations triggering alarms in advance of projected wake up time of any of the children, aspects may compare the current sleep cycles and patterns, or otherwise determine the general quality of sleep or restfulness of Devon and Leslie, and selecting the one that is most rested, or most nearly awake, for waking now, in advance of the child recognized as now (or soon) waking up. Thus, an alarm personal to the selected one of Devon and Leslie is triggered, one that wakes only the selected caregiver (such as a vibration of a wearable device); or a unique alarm tone sounds that also wakes the other caregiver, but recognizing that the alarm is only for the selected caregiver, said other caregiver may go back to sleep. By customizing the type of alarm and length of advance readiness period of time to the selected caregiver's current sleep status (lengthening or shortening as needed), said alerted caregiver is given an opportunity to slowly and appropriately wake up and get ready.

Devon and Leslie may also define different parent-child responsibility pairings based on identifying and respectively assigning different personal assistance tasks possibly needed by the children upon waking. An appropriate parent is thus chosen that is associated with care need selected from a universal list (plurality) of possible personal assistance tasks applicable to care of the dependent children that is most likely needed by the waking dependent child. Aspects thereby trigger selective alarms in response to unique needs of the different caregivers and children within each pairing.

For example, caregiver Devon is associated with wake probabilities triggered for either of the older twins by sleep pattern data indicating that they will wake soon (optimally a future time from now equal to an elapse of Devon's current personal readiness time period as defined for getting ready to meet the needs of either of the older twins). This may be in response to a general rule applicable to this pairing, such as Devon is assigned to wake by default to tend to the older children; or to determining a type of assistance indicated as required by the dependent child sleep data, for example that they need help dressing but not in administering medication, a task that is instead allocated to Leslie. In contrast, Leslie may be linked to either of the younger, infant twins as primary feeding or diaper-changing caregiver. In response to a determination that either of the infants will wake (if possible, by Leslie's response period of time into the future), and wherein their sleep patterns indicate that the wake probability is associated with sleep pattern data indicating that they will wake from hunger or from a need for a diaper change, Leslie is then selectively woken, and Devon may remain asleep (or go back to sleep).

Devon and Leslie may also define preferences for their respective selection for waking in response to probable waking determinations for the children. For example, one caregiver may need a break, so the other caregiver agrees to be "preferred" to be the one to be awoken, or at least the next time. They may define a "round-robin" selection process in order to take turns in waking each time a wake probability value triggers an alarm, or to take turns with a bias toward one caregiver over another: for example, Devon this time, Leslie the next time or the next two times, then Devon again, etc. Preferences may also set to bias or favor or more frequently select one caregiver over the other on an ongoing or periodic basis, for example favoring (selecting) one caregiver 25% of the time, and thus the other caregiver % 75 of the time, including as a function of s defined time period (over the next month, etc.). Still other selection preferences will be apparent to one skilled in the art.

Thus, only one, appropriate caregiver need be woken for a given wake probability determination, and in an appropriate alarm manner, with advance timing to allow the woken caregiver time to get ready and cheerfully and peacefully tend to the waking child, increasing the satisfaction and happiness of all.

Aspects may be deployed to meet a wide variety of caregiver and dependent pairings, including where elderly family members are being cared for by younger members of a family, or for short-term needs, such as associated with illness. For example, a child or significant other may suffer from a virus or allergy for a specific time frame (days, weeks of an allergy season, etc.), wherein a dependent does not sleep in a usual sleep pattern (for example, waking up to use the bathroom or because their nose is blocked). Aspects may customize determinations from monitored sleep data during these short term episodes, taking additional situational data into consideration to analyze patterns differently during these anomalous periods, relative to the determinations make during normal sleep pattern periods and patterns measured or matched at this time would not be applied to analytics for normal sleep activity when there is no illness.

Aspects may also look for variations in sleep activity that may indicate an upcoming issue, such as nasal congestion indicative of the onset of seasonal allergy symptoms, and recognize associated sleep pattern and adjust determined wake probabilities accordingly. For example, aspects may increase wake probability values determined from observing certain breathing patterns in response to recognizing nasal congestion indicative of an onset of seasonal allergy symptoms in the dependent. Aspects may also increasing wake probability values responsive to recognizing sleep apnea onset indications in the monitored sleep data.

Aspects thus address disadvantages in assuring adequate rest to caregivers with respect to meeting the needs of dependents presented by conventional alarm systems and methods. Newly born infants may wake up during a night sleeping period, or earlier in the morning than a parent, and waken the parent by loud audial stimuli (crying, yelling, etc.) in demanding attention of the parent. Parents woken in response to such stimuli may feel startled, and unrested, which may result in yelling at their children and grouchiness. Unpredictable alarm times that interrupt sleep patterns and schedules may also have debilitating effects, leaving alarm users feeling tired and unrefreshed. Some studies indicate that perceived afternoon energy levels may be predicted by what a person does when first awoken, wherein being awoken by an alarm or otherwise experiencing a jarring or frantic start to the day may leave a person feeling relatively more poorly later in the day, with lower perceived levels of energy, creativity, spontaneity, concentration, motivation, tolerance for stress, etc., relative to awaking from sleep naturally, such as at the end of an appropriate sleep cycle in response to internal biological clock and sleep-wake homeostat system functioning. (See "You Could Wake Up Naturally to a More Energized Day: Small Changes Can Mean BIG Energy," M. Kramer, Sparkpeople, August 2016, http://www.sparkpeople.com/resource/wellness_articles.asp?id=329.) In contrast, aspects of the present invention enable the timely execution of more gentle alarm stimuli and waking methodology in advance of sudden eruptions of infant crying, giving caregivers time to mentally prepare to abate the crying via assistance to the dependents, reducing stress on the caregivers.

The terminology used herein is for describing particular aspects only and is not intended to be limiting of the invention. As used herein, the singular forms "a", "an" and "the" are intended to include the plural forms as well, unless the context clearly indicates otherwise. It will be further understood that the terms "include" and "including" when used in this specification specify the presence of stated features, integers, steps, operations, elements, and/or components, but do not preclude the presence or addition of one or more other features, integers, steps, operations, elements, components, and/or groups thereof. Certain examples and elements described in the present specification, including in the claims and as illustrated in the figures, may be distinguished or otherwise identified from others by unique adjectives (e.g. a "first" element distinguished from another "second" or "third" of a plurality of elements, a "primary" distinguished from a "secondary" one or "another" item, etc.) Such identifying adjectives are generally used to reduce confusion or uncertainty, and are not to be construed to limit the claims to any specific illustrated element or embodiment, or to imply any precedence, ordering or ranking of any claim elements, limitations or process steps.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A computer-implemented method for optimizing an alarm time as a function of biometric sleep data, comprising executing on a computer processor the steps of:

generating biometric sleep data from monitoring a sleeping person;

determining a readiness period of time required for a selected caregiver to complete a task prior to tending to the sleeping person;

determining from the biometric sleep data of the sleeping person a probability that the sleeping person will wake within said readiness time period from a current time; and in response to the determined wake probability meeting a threshold certainty value, initializing an alarm to the selected caregiver.

2. The method of claim 1, further comprising:

integrating computer-readable program code into a computer system comprising a processor, a computer readable memory in circuit communication with the processor, and a computer readable storage medium in circuit communication with the processor; and wherein the processor executes program code instructions stored on the computer-readable storage medium via the computer readable memory and thereby performs the steps of generating the biometric sleep data from monitoring the sleeping person, determining the readiness time period for the selected caregiver to complete the task prior to tending to the sleeping person, determining from the biometric sleep data of the sleeping person the probability that the sleeping person will wake within said readiness time period from the current time, and initializing the alarm to the selected caregiver in response to the determined wake probability meeting the threshold certainty value.

3. The method of claim 2, wherein the computer-readable program code is provided as a service in a cloud environment.

4. The method of claim 1, wherein the selected caregiver is sleeping, the method further comprising:

generating biometric sleep data from monitoring the selected sleeping caregiver; and revising a length of the readiness time period as a function of the biometric sleep data of the selected caregiver.

5. The method of claim 4, wherein generating the biometric sleep data generates for the sleeping person observations selected from the group consisting of movements, sleep cycle identifications, sleep movement patterns, sounds, oxygen levels, breathing rates, restlessness, efficiency, and body temperatures.

6. The method of claim 5, further comprising:

selecting the selected caregiver from a plurality of sleeping caregivers that are each available to provide personal care or assistance to the sleeping person, in response to determining from their respective biometric sleep data that the selected caregiver is more rested, or more nearly awake, relative to another of the plurality of sleeping caregivers.

7. The method of claim 5, further comprising:

in response to the determined wake probability meeting the threshold certainty value, determining a specific personal assistance task that is most likely needed by the sleeping person upon waking, from a universal plurality of personal assistance tasks that are each applicable to care of the sleeping person; and selecting the selected caregiver from a plurality of caregivers that are each available to provide personal care or assistance to the sleeping person, in response to an association of the selected caregiver with the specific personal assistance task that is most likely needed by the sleeping person upon waking, relative to another of the plurality of caregivers that is associated with a different one of the universal plurality of personal assistance tasks.

8. The method of claim 5, further comprising:

learning a length of the readiness time period over time in response to feedback of observations of timeliness of the alarm time by the selected caregiver.

9. The method of claim 5, further comprising:

determining the readiness period of as a function of time period data that is selected from the group consisting of a minimum time period specified for a task and a historic readiness time period observed for the caregiver.

10. A system, comprising:

a processor;

a computer readable memory in circuit communication with the processor; and a computer readable storage medium in circuit communication with the processor;

wherein the processor executes program instructions stored on the computer-readable storage medium via the computer readable memory and thereby:

generates biometric sleep data from monitoring a sleeping person;

determines a readiness period of time required for a selected caregiver to complete a task prior to tending to the sleeping person;

determines from the biometric sleep data of the sleeping person a probability that the sleeping person will wake within said readiness time period from a current time; and in response to the determined wake probability meeting a threshold certainty value, initializes an alarm to the selected caregiver.

11. The system of claim 10, wherein the selected caregiver is sleeping, and wherein the processor executes the program instructions stored on the computer-readable storage medium via the computer readable memory and thereby:

generates biometric sleep data from monitoring the selected sleeping caregiver; and revises a length of the readiness time period as a function of the biometric sleep data of the selected caregiver.

12. The system of claim 11, wherein the processor executes the program instructions stored on the computer-readable storage medium via the computer readable memory and thereby:

generates for the sleeping person biometric sleep data observations selected from the group consisting of movements, sleep cycle identifications, sleep movement patterns, sounds, oxygen levels, breathing rates, restlessness, efficiency, and body temperatures.

13. The system of claim 11, wherein the processor executes the program instructions stored on the computer-readable storage medium via the computer readable memory and thereby:

selects the selected caregiver from a plurality of sleeping caregivers that are each available to provide personal care or assistance to the sleeping person, in response to determining from their respective biometric sleep data that the selected caregiver is more rested, or more nearly awake, relative to another of the plurality of sleeping caregivers.

14. The system of claim 11, wherein the processor executes the program instructions stored on the computer-readable storage medium via the computer readable memory and thereby:

in response to the determined wake probability meeting the threshold certainty value, determines a specific personal assistance task that is most likely needed by the sleeping person upon waking, from a universal plurality of personal assistance tasks that are each applicable to care of the sleeping person; and selects the selected caregiver from a plurality of caregivers that are each available to provide personal care or assistance to the sleeping person, in response to an association of the selected caregiver with the specific personal assistance task that is most likely needed by the sleeping person upon waking, relative to another of the plurality of caregivers that is associated with a different one of the universal plurality of personal assistance tasks.

15. The system of claim 11, wherein the processor executes the program instructions stored on the computer-readable storage medium via the computer readable memory and thereby:

learns a length of the readiness time period over time in response to feedback of observations of timeliness of the alarm time by the selected caregiver.

16. A computer program product for optimizing an alarm time as a function of biometric sleep data, the computer program product comprising:

a computer readable storage medium having computer readable program code embodied therewith, wherein the computer readable storage medium is not a transitory signal per se, the computer readable program code comprising instructions for execution by a processor that cause the processor to:

generate biometric sleep data from monitoring a sleeping person;

determine a readiness period of time required for a selected caregiver to complete a task prior to tending to the sleeping person;

determine from the biometric sleep data of the sleeping person a probability that the sleeping person will wake within said readiness time period from a current time; and in response to the determined wake probability meeting a threshold certainty value, initialize an alarm to the selected caregiver.

17. The computer program product of claim 16, wherein the selected caregiver is sleeping, and wherein the computer readable program code instructions for execution by the processor further cause the processor to:

generate biometric sleep data from monitoring the selected sleeping caregiver; and revise a length of the readiness time period as a function of the biometric sleep data of the selected caregiver.

18. The computer program product of claim 17, wherein the computer readable program code instructions for execution by the processor further cause the processor to:

generate for the sleeping person biometric sleep data observations selected from the group consisting of movements, sleep cycle identifications, sleep movement patterns, sounds, oxygen levels, breathing rates, restlessness, efficiency, and body temperatures.

19. The computer program product of claim 17, wherein the computer readable program code instructions for execution by the processor further cause the processor to:

select the selected caregiver from a plurality of sleeping caregivers that are each available to provide personal care or assistance to the sleeping person, in response to determining from their respective biometric sleep data that the selected caregiver is more rested, or more nearly awake, relative to another of the plurality of sleeping caregivers.

20. The computer program product of claim 17, wherein the computer readable program code instructions for execution by the processor further cause the processor to:

in response to the determined wake probability meeting the threshold certainty value, determine a specific personal assistance task that is most likely needed by the sleeping person upon waking, from a universal plurality of personal assistance tasks that are each applicable to care of the sleeping person; and select the selected caregiver from a plurality of caregivers that are each available to provide personal care or assistance to the sleeping person, in response to an association of the selected caregiver with the specific personal assistance task that is most likely needed by the sleeping person upon waking, relative to another of the plurality of caregivers that is associated with a different one of the universal plurality of personal assistance tasks.

* * * * *